US005636599A

United States Patent [19]

Russell

[11] Patent Number: 5,636,599

[45] Date of Patent: Jun. 10, 1997

[54] CYLINDER ASSEMBLY

[76] Inventor: Robert L. Russell, 979 Walnut Ridge Ct., Frankfort, Ill. 60423

[21] Appl. No.: 472,891

[22] Filed: Jun. 7, 1995

[51] Int. Cl.[6] ..... F02B 57/08

[52] U.S. Cl. ..... 123/44 B; 123/54.1

[58] Field of Search ..... 123/54.1, 54.2, 123/43 R, 44 R, 44 B, 669

[56] References Cited

U.S. PATENT DOCUMENTS

| | | | |
|---|---|---|---|
| 683,834 | 10/1901 | Beckfield | 123/44 B |
| 696,251 | 3/1902 | McFarland | 123/44 B |
| 760,318 | 5/1904 | Dickson et al. | 123/44 B |
| 936,036 | 10/1909 | Reimers | 123/44 B |
| 1,476,264 | 12/1923 | Matthews . | |
| 1,527,598 | 2/1925 | Magann . | |
| 1,533,514 | 4/1925 | Ragot | 123/54.1 |
| 1,665,468 | 4/1928 | Murray, Jr. . | |
| 1,825,769 | 10/1931 | Barbarou . | |
| 1,832,282 | 11/1931 | Deeble . | |
| 1,890,914 | 12/1932 | Parsons, Sr. . | |
| 3,069,209 | 12/1962 | Bauer . | |
| 3,542,000 | 11/1970 | Ellingsen . | |
| 3,874,348 | 4/1975 | Townsend | 123/44 B |
| 4,530,316 | 7/1985 | Morrison | 123/44 R |
| 4,653,438 | 3/1987 | Russell | 123/44 B |
| 5,146,880 | 9/1992 | Mayne | 123/54.2 |
| 5,303,682 | 4/1994 | Donahue et al. | 123/193.1 |

FOREIGN PATENT DOCUMENTS

| | | | |
|---|---|---|---|
| 115873 | 5/1918 | United Kingdom | 123/44 B |

*Primary Examiner*—David A. Okonsky
*Attorney, Agent, or Firm*—McCaleb, Lucas & Brugman

[57] ABSTRACT

A unitary cylinder useful in internal combustion engines having external threads at one end for a connection with the engine; the cylinder providing internal bearing support to an associated piston mounted internally thereof and external bearing support to a cam actuated saddle embracing the cylinder's exterior. Elongated openings in opposing walls of the cylinder accommodate passage of a transverse wrist pin connection between the internal piston and external saddle.

1 Claim, 3 Drawing Sheets

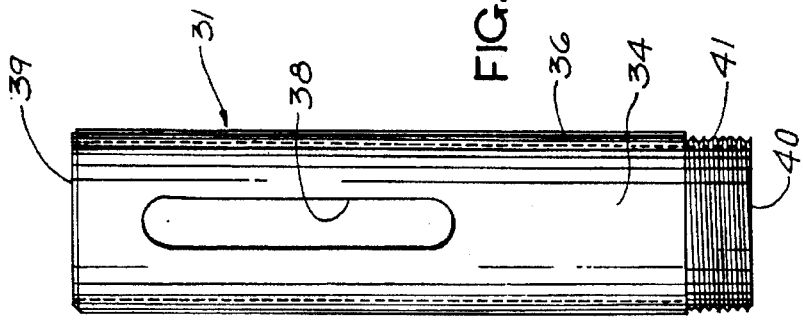
FIG. 4
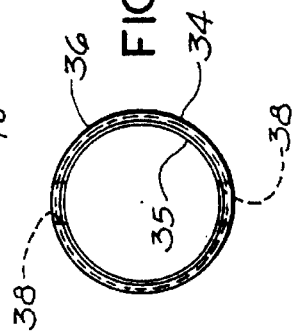
FIG. 5
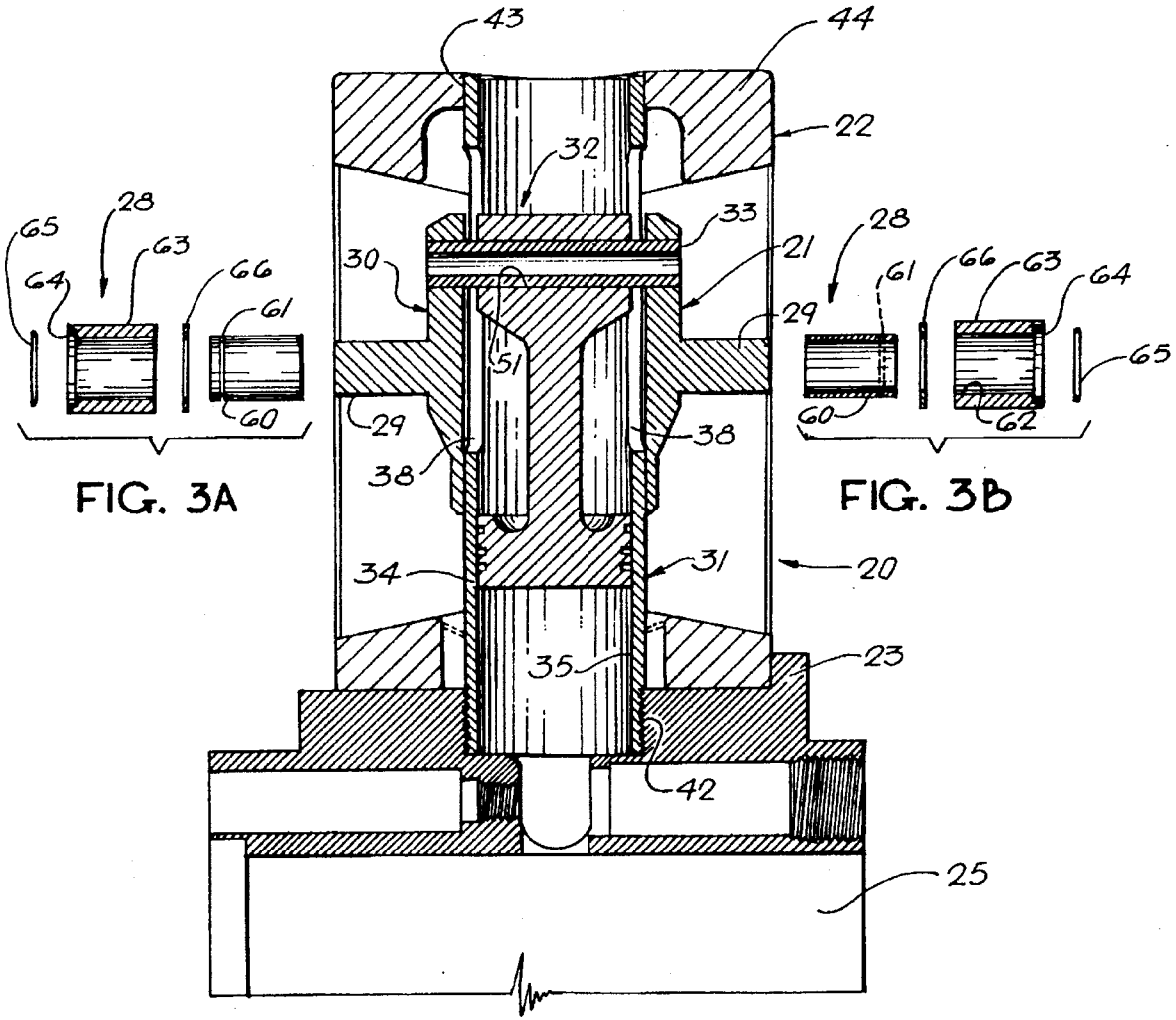
FIG. 3B
FIG. 3A
FIG. 3

CYLINDER ASSEMBLY

This invention relates generally to internal combustion engines and like piston actuated mechanisms, and more particularly to an improved cylinder assembly especially useful in rotary engines employing stationary cams for controlling reciprocation of the engine's pistons.

In the familiar internal combustion engine, the combustion cylinders are cast integrally with a engine block and then machined to provide smooth walled cylindrical interior bearing surfaces. In some cases the cylinder's smooth wall interior is accomplished by use of an insertible cylindrical liner, many times made of metal having good wear resistance characteristics and/or high thermal conductivity for improved engine performance. In other instances a sizeable portion of the cylinder may be incorporated in a removeable cylinder head.

It is well recognized that cylinder failures in the above briefly described conventional, internal combustion engines are very difficult, if not impossible, to repair or remedy, to say nothing of the extensive labor and time involved in any such attempted repair.

BRIEF SUMMARY OF THE INVENTION

In contrast to conventional cylinder assemblies, the present invention provides a unitary, open ended cylinder having external threads adjacent one end whereby the cylinder may be threadingly connected to and removed from its operating position in an internal combustion engine or the like. In the preferred embodiment disclosed herein the cylinder has smooth ground interior and exterior wall surfaces and a pair of diametrically opposed slotted openings through the walls thereof which extend partially along the length of the cylinder. A unitary piston having an integral connecting rod at one end which is receptive of a transverse wrist pin is mounted within the cylinder to reciprocate coaxially thereof in bearing relation with the cylinder's interior surface. The wrist pin extends through slotted openings in the cylinder walls and is coupled to a cam driven yoke located exteriorly of the cylinder. The yoke has a cylindrical body which embraces and rides in bearing relation with the smooth ground exterior of the cylinder during reciprocating activity of the piston.

It is an important object of this invention to provide a novel, removeably mounted combustion cylinder for internal combustion engines.

It is a further object of this invention to provide a novel combustion cylinder for use in internal combustion engines which has internal and external cylindrical bearing surfaces.

It is another important object of this invention to provide a novel combustion cylinder and piston assembly useful in internal combustion engines and like piston driven mechanisms.

It is a further important object of this invention to provide a novel internal combustion engine cylinder that provides an internal bearing support to a piston and external bearing support to a piston actuating saddle.

Having described this invention, the above and further objects, features and advantages thereof will appear from the following description of a preferred embodiment thereof illustrated in the accompanying drawings and representing the best mode presently contemplated for enabling those skilled in the art to practice this invention.

IN THE DRAWINGS

FIG. 3 is an enlarged detailed cross sectional view of a portion of the engine embodying the cylinder assembly hereof, taken substantially along vantage line 3—3 of FIG. 1 and looking in the direction of the arrows thereon;

FIGS. 3A and 3B are enlarged exploded views with portions in cross section of the left and right hand cam follower assemblies, respectively, shown in FIG. 2;

FIG. 4 is a right side elevational view of the cylinder shown in FIG. 3;

FIG. 5 is a top plan view thereof;

DESCRIPTION OF THE PREFERRED EMBODIMENT

Figure 2:
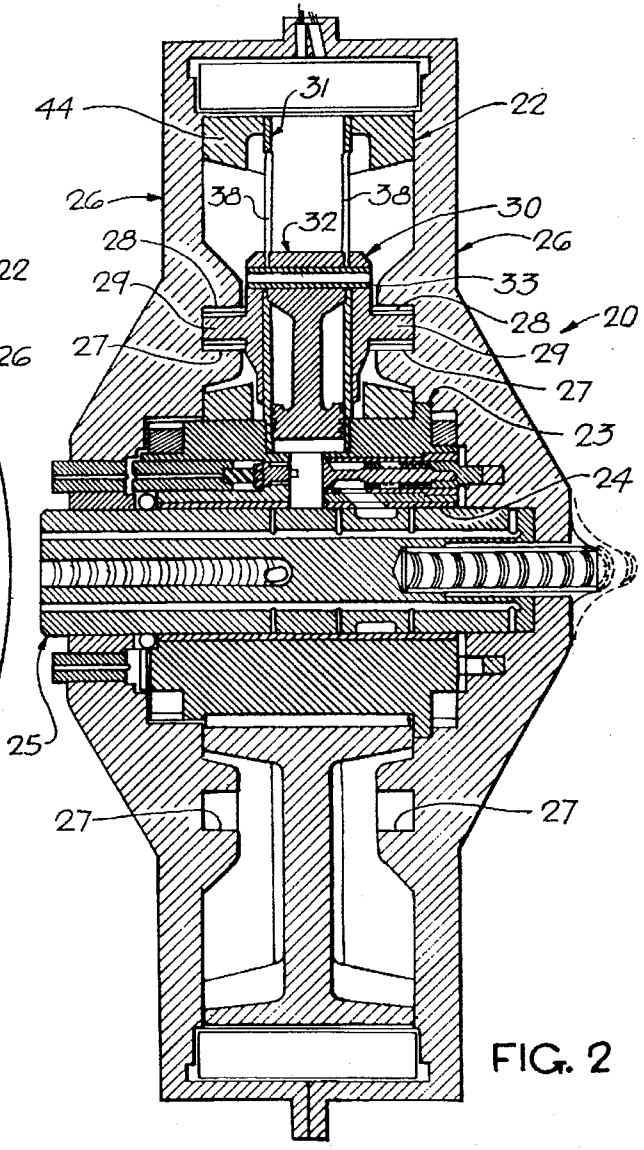
FIG. 2 is a cross sectional view of the engine shown in FIG. 1 taken substantially along vantage line 2—2 of FIG. 1 and looking in the direction of the arrows thereon.
Figure 1:
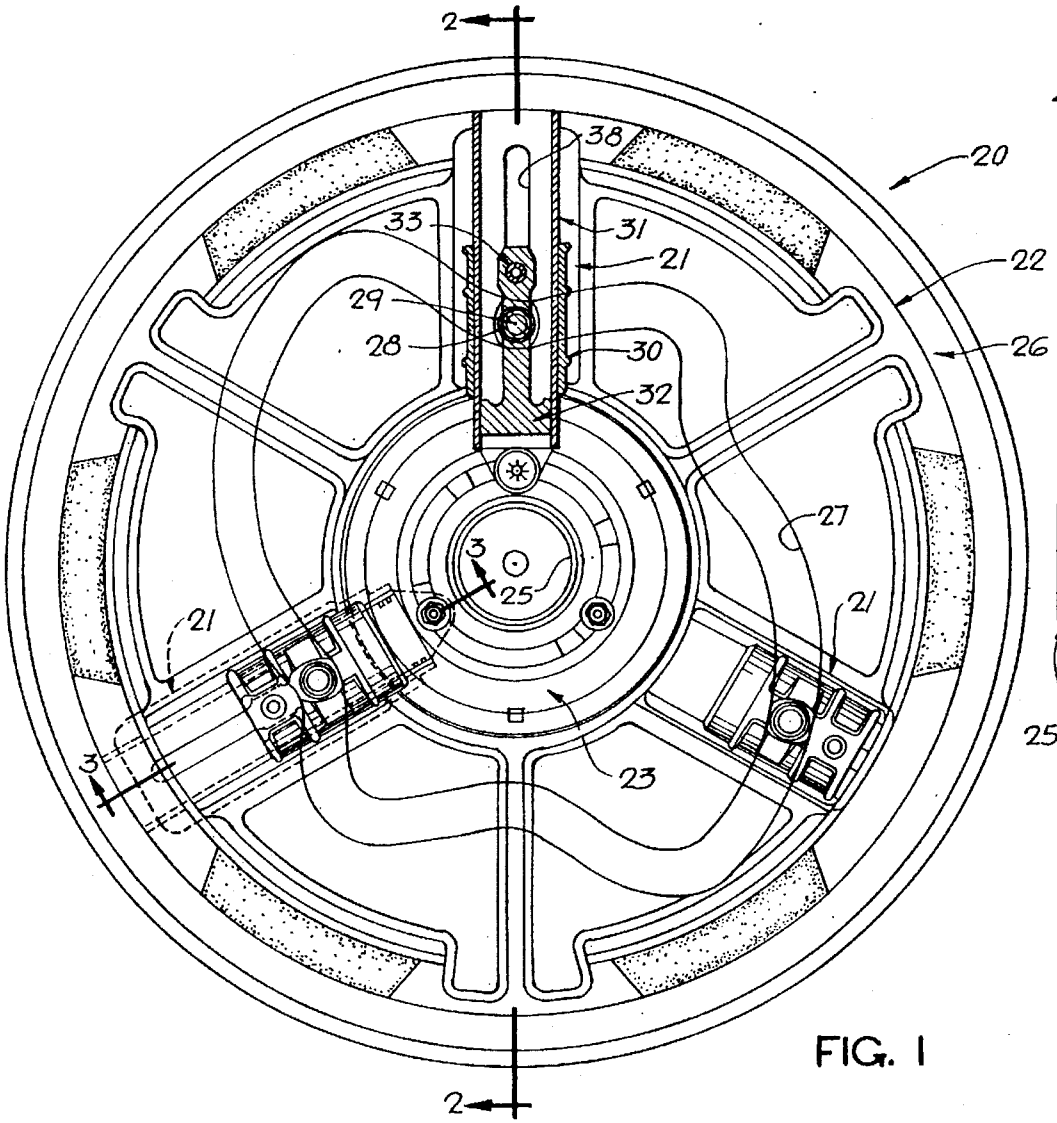
FIG. 1 is a partial elevational view, with parts in section, of a rotary engine embodying the improved cylinder assembly of this invention.

Turning now to the preferred embodiment of this invention, illustrated in the drawings, initial references is made to FIGS. 1 and 2 wherein a partial showing of a rotary cam plate type engine is indicated generally at 20 to comprise a plurality of cylinder assemblies 21 hereof carried radially of a rotor 22 that rotates with a central, generally cylindrical combustion chamber member 23 supported on a main bearing 24 concentrically surrounding a stationary main shaft 25. Two parallel, stationary cam plates 26, 26 each having a continuous recessed cam track 27 are disposed adjacent opposite axial ends of the rotor 22 to engage cam followers 28, rotatably mounted on pintles 29 extending coaxially from opposite sides of a generally cylindrical saddle means 30. The saddle means reciprocates over the exterior of each cylinder 31 of assembly 21 and is connected to a related piston 32 within the cylinder by means of a wrist pin 33 whereby each piston is reciprocated within its cylinder in response to movement of the rotor and actuation of the saddle means in accordance with the configuration of the opposing cam tracks 27.

A rotary engine having the general features and characteristics of engine 20 is described more fully in my U.S. Pat. No. 4,653,438, issued Mar. 31, 1987. It is to be understood that the particulars of engine 20 are not essential to the present invention other than to illustrate one context in which the novel cylinder assembly 21 hereof finds useful application. Other piston driven mechanisms, such as pumps, for example, are also likely areas of use.

Turning now to the specifics of the cylinder assembly 21, reference is made initially to FIG. 3 of the drawings showing the assembled cylinder 31, piston 32 and external saddle means 30 mounted in operating position in engine 20.

As best shown in FIGS. 4 and 5, cylinder 31 is an elongated metal cylinder formed by a body 34 having smooth ground interior and exterior cylindrical surfaces 35 and 36, respectively, and a wall thickness in the order of ¼", by way of example. Two elongated, slotted openings 38, 38 are formed intermediate the open ends 39 and 40 of the body 34. Such openings 38 are diametrically opposed on opposite sides of the cylinder and have radiused or semi-circular upper and lower ends. The slotted openings receive a cylindrical wrist pin 33 therethrough in assembly with a related piston and saddle means, as will appear more fully hereinafter.

Uniquely, an axially extending portion of the cylindrical body's exterior, adjacent it's lower end 40, is formed with external threads 41 which cooperate with a threaded opening 42 formed, in this case, in the combustion chamber member 23 (see FIG. 3) for mounting the cylinder in operating position in the engine. It will be noted that the upper end 39 of the cylinder extends through a cylindrical opening 43 formed in an outer annular wall 44 of the rotor 22 with close fitting engagement whereby to provide a resistance fit with the exterior surface 36 of body 34.

Figure 8:
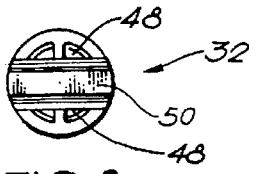
FIG. 8 is a top plan view thereof.
Figure 12:
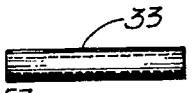
FIG. 12 is a side elevation of the wrist pin shown in FIGS. 1–3.
Figure 6:
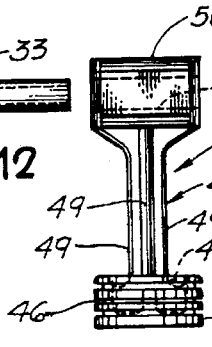
FIG. 6 is a front elevation of the piston shown in FIG. 3.
Figure 7:
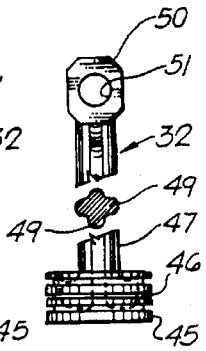
FIG. 7 is a right side elevation thereof, broken away to show the connecting rod cross sectional configuration.

As best seen in FIGS. 6–8 of the drawings, each piston 32 is formed as a unified casting, preferably of lightweight metal or metal alloy, to comprise a cylindrical piston head portion 45 at it's lower end having the usual annular circumferential grooves 46 for mounting piston rings (not shown) whereby to produce sealing engagement with the inside surface 35 of the cylinder body 34 in operation. Piston head portion 45 is integrally formed with a coaxially extending piston rod 47 having a ribbed cross section defined by four ribs 49 as shown in FIG. 7. It will be noted that the piston head portion 45 is formed with four open topped hollow interior quadrants 48 separated by integral continuations of the ribs 49 formed along the length of the piston rod 47 whereby to reduce the overall weight of the piston. The upper end of piston rod 47 is distinguished by a transversely extending integral cross head 50 having an axial cylindrical bore 51 for receiving the cylindrical wrist pin 33 therethrough (see FIG. 12). Thus the piston 32, operatively located within the cylinder 31, is coupled by pin 33 to the saddle means 30 located exteriorly of the cylinder.

Figure 11:
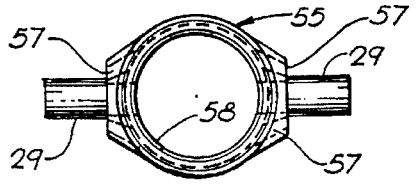
FIG. 11 is a top plan view thereof.
Figure 9:
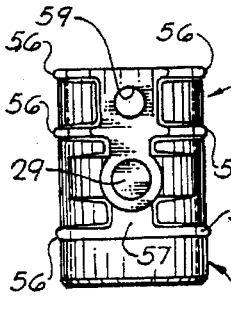
FIG. 9 is a right side elevation of the cam actuated saddle shown in FIG. 3, at a reduced scale therefrom.
Figure 10:
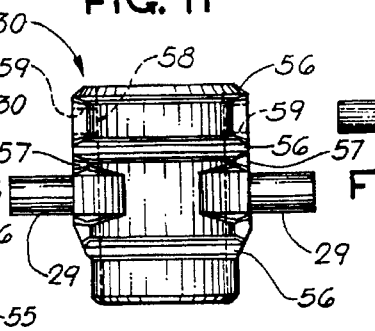
FIG. 10 is a front elevation thereof.

Saddle means 30 as best shown in FIGS. 9–11, comprises a unitary, cast, generally cylindrical body 55 of lightweight aluminum or other lightweight material. Body 55 is distinguished by several axially spaced circumferential reinforcing ribs 56, 56 protruding radially outwardly thereof and a pair of coaxially aligned cylindrical pintles 29 projecting radially outwardly from axially extending reinforcing ribs 57 located at diametrically opposite sides of body 55. It will be understood that the ribs and pintles preferably are integral portions of body 55. Internally body 55 is formed with a cylindrical, smooth walled axially extending bore 58 which has bearing engagement with the exterior surface 36 of the previously described cylinder body 34 in operation. In this latter respect, pintles 29 carry the cam followers 28 (see FIGS. 3A and 3B) which ride in the cam tracks 27 on opposite sides of the cylinder assembly whereby to effect axial reciprocation of the saddle means as previously related.

In order for the saddle means to transmit its reciprocating movements to a piston 32, the saddle body is provided with a pair of coaxially aligned bores 59, 59 located adjacent the upper ends of the exterior axially extending rib portions 57 (see FIG. 9). The two bores 59 receive the cylindrical ends of a wrist pin 33 with a press fit relation. A major portion of the pin 33 passes through bore 51 of the piston cross head 50, to couple each piston to its associated saddle means.

It is noteworthy that while the piston 32 associated with each cylinder has bearing relationship with the interior surface 35 thereof, the internal bore 58 of the saddle body is in bearing relation with the external surface 36 of the cylinder according to that objective of this invention.

It will be noted from FIGS. 3A and 3B that each of the cam followers 28 comprises an assembly including a cylindrical sleeve bearing 60 having an external groove 61 operationally located near an outer end thereof. Bearing 60 is press fit over the cylindrical exterior of an associated cylindrical pintle 29 of the saddle means, while the cylindrical exterior thereof fits close within a cylindrical bore 62 of a track engaging follower member 63. The outer end of bore 62 is suitably counterbored at 64 to receive a locking ring 65 which operatively engages the groove 61 of sleeve bearing 60 after the follower member 63 is assembled thereover. A lock ring 65 serves to axially interlock the members 63 and bearing 60. In addition a suitable ring type thrust bearing 66 is mounted between the operational inner end of the follower member and the body 55 of the saddle means to complete the follower assembly.

From the foregoing it is believed that those skilled in the art will readily recognize and appreciate the novel advancement of this invention over the prior art and will understand that while the same has been described herein and associated with a preferred illustrated embodiment thereof, the same is nevertheless susceptible to variation, modification and substitution of equivalents without departing from the spirit and scope of the invention which is intended to be unlimited by the foregoing except as may appear in the following appended claims.

The embodiments of the invention in which an exclusive property or privilege is claimed are defined as follows:

1. An improved cylinder assembly for use in internal combustion engines and like piston driven mechanisms comprising:

a unitary, elongated, rigid metal body defining an axially extending cylinder; said body having a pair of registeringly aligned elongated openings extending through diametrically opposing walls of said cylinder; and a piston guiding cylindrical bearing surface formed on the interior walls of said cylinder;

external thread means at one end of said body for detachably connecting the same in operating position in an engine or piston driven mechanism;

a unitary piston mounted in said cylinder comprising integrally related piston head, connecting rod and cross head portions;

the exterior of said body presenting an exterior cylindrical bearing surface;

a generally cylindrical, reciprocally actuated saddle mounted coaxially about the exterior of said body and having an internal cylindrical bore in bearing relation with said exterior bearing surface of said body; and a wrist pin extending through said cross head portion, said elongated openings and registeringly aligned openings in said saddle whereby to interconnect said piston and saddle for conjoint coaxial movement in bearing relation with the cylindrical interior and exterior surfaces, respectively, of said cylinder.

* * * * *